United States Patent [19]

Hunt et al.

[11] Patent Number: 4,466,901

[45] Date of Patent: Aug. 21, 1984

[54] MOLYBDENUM-CONTAINING FRICTION MODIFYING ADDITIVE FOR LUBRICATING OILS

[75] Inventors: Mack W. Hunt; Charles T. West, both of Naperville, Ill.

[73] Assignee: Standard Oil Company (Indiana), Chicago, Ill.

[21] Appl. No.: 387,623

[22] Filed: Jun. 11, 1982

[51] Int. Cl.[3] ..... C10M 1/54; C10M 1/48

[52] U.S. Cl. ..... 252/32.7 E; 252/42.7; 252/46.4; 252/46.7; 252/49.7

[58] Field of Search ..... 252/32.7 E, 42.7, 46.7, 252/49.7, 46.4

[56] References Cited

U.S. PATENT DOCUMENTS

| | | | |
|---|---|---|---|
| 4,201,683 | 5/1980 | Brewster | 252/49.7 |
| 4,266,945 | 5/1981 | Karn | 252/49.7 |
| 4,357,149 | 11/1982 | West et al. | 252/49.7 |

*Primary Examiner*—Jacqueline V. Howard

*Attorney, Agent, or Firm*—James L. Wilson; William T. McClain; William H. Magidson

[57] ABSTRACT

Lubricating oil composition comprising the reaction product of a phenolic compound, a molybdenum, an amine and sulfur or a sulfur-yielding compound. Preferably, molybdenum oxide, an alkyl-substituted phenol having an alkyl side chain of at least 9 carbon atoms, an amine having at least one aliphatic hydrocarbon-based radical or aliphatic-substituted aromatic radical and elemental sulfur are reacted to produce the reaction product of the invention.

7 Claims, No Drawings

MOLYBDENUM-CONTAINING FRICTION MODIFYING ADDITIVE FOR LUBRICATING OILS

BACKGROUND OF THE INVENTION

Molybdenum compounds have long been known as desirable lubricating oil additives for, among other things, friction reduction. Numerous molybdenum-containing compositions have been disclosed recently, including molybdenum-amine complexes, W. F. Marzluff, *Inorg. Chem.* 3, 345 (1964), molybdenum-oxazoline complexes, U.S. Pat. No. 4,176,074, Coupland, et al., and U.S. Pat. No. 4,176,073, Ryer, et al., molybdenum beta-keto esters, molybdenum diorganophosphates, U.S. Pat. No. 4,178,258, Papay, et al., etc.

A series of patents issued to King and De Vries and assigned to Chevron Research Company in 1981, disclosed lubricating oil compositions incorporating antioxidant molybdenum compounds, these patents being U.S. Pat. Nos. 4,259,194, 4,259,195, 4,261,843, 4,263,152, 4,265,773, 4,272,387, 4,283,295 and 4,285,822. The inventors state that the precise molecular formula of these molybdenum compounds is not known, but they are believed to be compounds with molybdenum oxides or sulfides complexed by or the salt of one or more nitrogen atoms from a basic nitrogen-containing composition (such as e.g., succinimide, carboxycyclic acid amide and Mannich bases) used to prepare the lubricant. U.S. Pat. No. 4,266,945, Karn, discloses a molybdenum-containing compound resulting from the reaction of a molybdenum acid (or salt thereof), a phenol or a condensation product of the phenol and a lower aldehyde, and a primary of secondary alkyl amine. U.S. Pat. No. 3,047,500, Matson, discloses what the patentees believe to be a molybdenum sulfide formed in situ as a result of the interaction of a molybdenum phenolate and an oil-soluble organic sulfur compound. These two ingredients are added to a lubricant for extreme pressure protection, there being no chemical interaction between the molybdenum and sulfur until substantial heat has been generated on the worked surfaces to produce the molybdenum sulfide. U.S. Pat. No. 4,202,781, Sabol, et al., a method of preparing a molybdenum phosphosulfurized hydrocarbon composition is disclosed, the composition being useful as an oxidation inhibitor and friction modifier for lubricants of internal combustion engines. The reaction disclosed products stable molybdenum-containing compositions without high temperatures, the use of ketone or ether-complexing solvents, or hydrogen peroxide.

The molybdenum compounds produced by the methods of the above-noted patents, all of which are expressly incorporated by reference herein, potentially suffer from either economic inefficiencies or from changing product requirements. For instance, at least one major U.S. automobile manufacturer has specified a maximum level of 0.11 percent phosphorus in motor oils used in internal combustion engines in 1983 and thereafter. Most commercially available oil-soluble molybdenum additives having anti-friction properties in lubricating oil contain phosphorus in the form of phosphosulfurized hydrocarbons or thiophosphates. However, the most effective antiwear additive commonly used in lubricating oils is a zinc-phosphorus composition, such as zinc dithiophosphate, which is useful in amounts to potentially account for the entire phosphorus "allotment" in lubricating oil. Therefore, a need exists for a molybdenum-containing additive which provides friction reduction properties at low cost without the use of phosphorus.

While the molybdenum compositions noted above can improve the characteristics of lubricating oils, they suffer the additional drawbacks that they are often uneconomical or difficult to prepare, cannot be prepared in a batch process, and may or may not have sufficient amounts of sulfur incorporated within the additive to benefit fully from the molybdenum contained therein. Accordingly, a need exists for an oil-soluble molybdenum composition which can be economically prepared, and which can provide high levels of activity to lubricating oils.

SUMMARY OF THE INVENTION

The lubricating oil anti-friction additive composition of the present invention can be prepared by reacting a phenolic compound, a molybdenum compound, an amine compound and sulfur or a sulfur-yielding compound under reaction conditions. Preferably, the molybdenum compound comprises molybdenum oxide or ammonium molybdate or the alkali metal salts thereof, and the phenolic compound comprises an alkyl-substituted phenol having an alkyl side chain with at least nine carbon atoms. Representative alkyl side chains comprise propene or butene, trimers or tetramers of propene, copolymers of ethylene and propylene or $C_{10}$ to $C_{20}$ polyethylenes. The amine compound can comprise a mono- or polyamine having at least one aliphatic hydrocarbon, or an aromatic or aliphatic-substituted aromatic radical. The polyamine can be represented by the general formula $NH_2[(CH_2)_xNH]_zH$, wherein x is an integer from 2–6 and z is an integer from 1–10. Sulfur is preferably provided in excess quantities, with a sulfur/amine molar ratio of from 1 to 60.

DETAILED DESCRIPTION OF THE INVENTION

The general object of this invention is to improve the properties of lubricating oils with oil-soluble molybdenum compounds. Other objects appear hereinafter.

We have discovered improved oil-soluble molybdenum compositions, and methods for making these compositions, which comprise the reaction and reaction products of a molybdenum compound, an amine compound, a phenolic compound and sulfur or a sulfur-yielding compound. Preferably, the amine compound has a molecular weight less than about 200–250 so that it remains oil soluble. The additive prepared can be added to a lubricating oil in a concentration of from 0.01 to 10.0 percent, by weight of the oil. The reaction product of this invention is useful as an additive for lubricants providing friction reduction. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, marine and railroad diesel engines and the like. They can also be used in gas engines, stationary power engines and turbines and the like. Automatic transmission fluids, transaxle lubricants, gear lubricants, metalworking lubricants, hydraulic fluids and other lubricating oil and grease compositions can also benefit from the incorporation therein of the compositions of the present invention.

Natural oils include animal oils and vegetable oils (e.g., Castor Oil, Lard Oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halo-substituted hydrocarbon oils such as polymerized and inter-polymerized olefins, alkyl benzenes, polyphenyls, alkylated diphenyl esters and alkylated diphenyl sulfides and the derivatives, analogs, and homologs thereof. Other useful synthetic lubricating oils include esters of dicarboxylic acids, cyclone-based oils, and esters of phosphorus-containing acids.

The present invention may be used in combination with other additives in a lubricant additive package. Such additives include, for example, detergents and dispersants of the ash-producing or ashless type, corrosion- and oxidation-inhibiting agents, pour point depressing agents, auxiliary extreme pressure agents, color stabilizers and anti-foam agents.

Briefly, a batch reaction is performed wherein a molybdenum compound, an amine, a phenolic compound and sulfur or a sulfur-yielding compound are reacted to form the active molybdenum-containing compound of the present invention.

The molybdenum compounds useful herein are molybdenum oxides or ammonium molybdate or the salts thereof. Molybdenum oxide is the preferred molybdenum compound due to its availability, inexpensive cost and easy reactivity under reaction conditions. However, ammonium molybdate can be successfully utilized herein, as well as certain monovalent or divalent alkali metal salts thereof. More particularly, the $Li^+$, $Na^+$, $K^+$ or $Mg^{++}$ salts of ammonium molybdate are useful herein. A large number of molybdenum salts are disclosed in Kirk-Othmer, *Encyclopedia of Chemical Technology,* second edition, Vol. 13, pp. 649–652. While other molybdenum compounds may in some cases be useable, such as the molybdenum halides, the problems associated therewith (such as cost, reactivity, etc.) militate against their use.

The amine compounds useful in this invention are mono- and polyamines. The amine compound contains at least one aliphatic hydrocarbon-based radical or an aromatic or aliphatic-substituted aromatic radical. For instance, amines such as methylamine, ethylamine, propylamine, benzeneamine, p-aminotoline, diethylamine, ethylmethylamine, N-methylbenzeneamine, diethylmethylamine, tri-n-propylamine, cyclopropylethylmethylamine and N,N-dimethyl-benzeneamine may be used herein. Representative polyamines have the general formula $NH_2(CH_2)_xNHz^H$, wherein x is an integer from 2 to 6 and z is an integer from 1 to 10. Illustrative of suitable polyamines are ethylenediamine, trimethylenediamine, tetramethylenediamine, hexamethylenediamine, diethylenetriamine, triethylenetetraamine, tetraethylenepentamine, and other polyalkylene polyamines. The other useful polyamines include bis(amino-alkyl)-piperazine, bis(amino-alkyl)-alkylenediamine, bis(amino-alkyl)-ethylenediamine, N-aminoalkyl-morpholine, 1,3 propane polyamines and polyoxyalkyl polyamines. Especially preferred are those amine compounds having a molecular weight less than about 200–250, above which the amine compound becomes relatively oil soluble and begins diluting the molybdenum compound. Given equal amounts of a mono- or polyamine, the molybdenum compounds useful herein exhibit greater solubility in the lower molecular weight (i.e., molecular weight less than about 200–250) amine compounds than in the high molecular weight amine compounds. As compared to a low molecular weight amine compound, the higher molecular weight amines increase the delusion factor of a given amount of molybdenum, thereby requiring a larger amount of molybdenum per unit volume and increasing the cost of the molybdenum additive.

Because the relatively low molecular weight amines do not provide a means of solubilizing the molybdenum compound herein, an organic compound must be provided to oil-solubilize the molybdenum for incorporation into a lubricating oil. The organic compounds useful herein are oil-soluble phenolic compounds typically having at least a 9 carbon atom linear alkyl side chain. While there is in most cases no upper limit on the number of carbon atoms in the alkyl side chain, except as noted hereinafter, the lowest possible molecular weight side chain which maintains oil solubility is desirable due to the delusion effect of the higher molecular weight phenols. The molybdenum incorporated into the final molybdenum-containing compound is substantially diluted with the higher molecular weight phenolic compounds and increases the final cost of the lubricating oil containing the molybdenum additive. Therefore, while a polybutene having, for instance, a molecular weight of 2000, would provide oil solubility for the molybdenum compound, it would be somewhat less desirable than, for instance, a dedecylphenol.

Applicant has discovered that under certain reaction conditions necessary to produce the additive of the present invention, amine compounds contained in the lubricating oil can cause the formation of a lacquer layer on the cylinder walls of engines subjected to high-temperature motored engine tests. Therefore, while a certain amount of amine has been found to be necessary to catalyze the present reaction, it is desirable to have as little as possible of the amine compound incorporated into the final molybdenum-containing product. Therefore, at least a 1:1, and preferably a 4:1 or 5:1 sulfur to amine molar ratio is utilized to produce the additive of the present invention.

The phenolic compounds useful in this invention are alkyl-substituted phenols having an alkyl side chain comprising at least 9 atoms. Paramonoalkyl-substituted phenols having up to 150, or more, carbon atoms in the alkyl group, are useful herein. However, as with the amine compound, the higher molecular weight phenolic compounds tend to dilute the molybdenum-containing compound and ultimately increase the cost of the lubricating oil due to the diluted molybdenum-containing additive. Therefore, especially preferred phenolic compounds herein are the lowest molecular weight compounds which will effectively oil-solubilize the molybdenum-containing compound. The alkyl-phenolic compounds are made by the reaction of about 1 to 20 moles of phenol with one mole of a polyolefin in the presence of an alkylating catalyst (most commonly boron trifluoride compounds, acidic activated clays and strong ionic exchange resins) with subsequent filtration or decantation. Examples of alkyl groups useful in the present invention are polymers of, for instance, propene and butene, trimers (nonophenol) and tetramers (dodecylphenol) of propene, copolymers of, for example, ethylene and propylene or polymers of ethylene having from about 10 to about 20 carbon atoms. Polyethylene compounds exhibit somewhat different oil solubility characteristics then similar polymers of, for example, propene and butene, in that they become relatively oil insoluble at chain links of about 20 carbon atoms.

Sulfurized phenolic compounds are used herein, these compounds being prepared by the reaction of one of the phenolic compounds described above with elemental sulfur. Hydrogen sulfide, sulfur dioxide, phosphorus pentasulfide, inorganic sulfides and polysulfides can also be used. Fine particulate or molten elemental sulfur is preferred for reasons of ease of handling, high reactivity, availability and low cost.

Excess sulfur or sulfur-yielding compound is added to the reaction mixture; Applicant has found that the more sulfur that is incorporated into the molybdenum-containing compound, the better the friction-reducing properties of the additive. It is believed that a molybdenum-sulfide film is formed on the worked surfaces, with a layer of molybdenum atoms sandwiched between layers of sulfur atoms. Due to the relatively weak sulfur to sulfur bond, separate laminae will tend to slide over each other while adhering to the metal surfaces. Therefore, a molar ratio of sulfur to amine of from 1 to 60 can be effective, however a ratio of about 3 to 5 is effective to incorporate a sufficient quantity of sulfur in the final product.

The reactions herein can be performed in batch or continuous mode. In batch mode the reactant or reactants in appropriate diluent are added to a suitable reaction vessel. The product is then withdrawn to appropriate strippers, filters and other purification apparatus. In continuous mode, a stream of reactant or reactants is continuously combined at an appropriate rate and ratio in a vessel or horizontal reaction zone maintained at reaction temperature. The reaction mixture stream is continuously withdrawn from the zone and is directed to appropriate strippers and filters for purification.

The reactions can be run neat (solventless) or in inert solvents or diluents such as hexane, heptane, benzene, etc., optionally under an inert gas blanket such as nitrogen.

While Applicants do not wish to be held to any particular theory as to the reactions occurring in the present invention, or the active molybdenum-containing compound resulting therefrom, it would appear that a number of competing amination and sulfurization reactions are taking place leading to the formation of what is believed to be a molybdenum phenate. The hexavalent molybdenum is, it is believed, reacted with from 1–6 phenolic groups and completed with from 0–5 oxygen atoms.

The above-described reaction products of the present invention are effective additives for lubricating oil compositions when used in amounts of from about 0.01 to 10.0 weight percent based on the lubricating oil. Suitable lubricating base oils are mineral oils, petroleum oils, synthetic lubricating oils, etc. Concentrates of the additive composition of the present invention in a suitable base oil composition containing about 10 to about 90 weight percent of the additives based upon the oil alone or in combination with other well known additives can be used for blending with the lubricating oil in proportions designed to produce finished lubricants containing 0.01 to 10.0 weight percent of the product.

The additives of this invention are often evaluated for anti-oxidation activity, corrosion resistance, and friction reduction using the various tests noted below.

In the Copper Strip Test, a measure of corrosion resistance, a solution of decahydronaphthalene and the molybdenum additive of the present invention with 2 percent of the solution being the molybdenum additive of the present invention. A freshly polished copper strip is suspended in the solution which is heated in a water bath at reflux (100° C.). The temperature is maintained during the three-hour test period, which is conducted in the dark. After three hours, the strips are removed, rinsed with hexane and rated using copper corrosion standards. A rating of 1-A is essentially the same condition as observed in the original strip, while a 4-B rating is essentially black due to heavy corrosion, with intermediate ratings therebetween.

A Roxanna four-ball friction and wear tester is utilized in the four-ball test. A tetrahedral arrangement of four balls is maintained, with the lower three balls fixed in placed by a retainer ring. The uppermost ball, in a chuck, rotates thereagainst while the lower three balls are immersed in a lubricant containing the additive under consideration. An upward force against the uppermost ball is applied and the coefficient of friction is determined from the lateral torque exerted on the stationary three-ball arrangement by the rotating uppermost ball. The wear sear diameter is determined by measuring the diameter of the balls under a calibrated telescope.

The Air Hot Tube Test measures the tendency of a lubricant-additive composition to form deposits when injected into a glass capillary tube heated in an aluminum block. Air is injected into the tube while the lubricant is injected, with the test lasting 16 hours. The deposit-forming tendency is visually rated on a scale of 0 to 10, where 0 is totally covered with black deposits and 10 being a substantially clean (no deposits) tube.

The Amihot Test simulates the bearing weight loss during the corrosion in an automobile engine by measuring the copper or lead corrosion tendencies of a lubricating oil. Freshly polished and teared lead and copper coupons are suspended in a lubricating oil containing a small portion of a halocarbon mixture. Air is sparged through this mixture which is maintained at 165° C. for approximately 16 hours. After this time, the coupons are removed, rinsed and weighed, with a weight loss of more than about 2 miligrams being judged significant. (This test is an indication of the results which may be obtained in an L-38 Test.)

The Oil Thickening Test is a measure of the oxidation stability of a lubricating oil. Air is sparged through a lubricating oil which is heated to approximately 175° C., with the viscosity increase being measured after 24 hours and 40 hours.

In the Motored Engine Test, an internal combustion automobile engine is driven by an electric motor. The oil pan of the engine is heated to a given temperature similar to the operating temperature of the engine under various operating conditions. The amount of horsepower needed by the electric motor to overcome the friction between the moving parts and the automobile is measured.

The invention will be more fully understood by reference to the following specific examples illustrating various modifications of the invention, which should not be construed as limiting the scope of the invention.

EXAMPLE 1

To a one liter, three-necked, round bottom flask was added 262 grams (1 mole) of dodecylphenol, 15 grams (0.25 moles) ethylene diamine and 36 grams (0.25 moles) of molybdenum trioxide. This mixture was heated to 177° C. under a nitrogen blanket and held at this temperature for four hours. At that time, 110 grams of SX-5 (a 110-neutral mineral oil) was added and the mixture cooled below 100° C. A 50:50 (volume) mixture with n-hexane and the crude reaction product was centrifuged to remove unreacted solids. The organic phase was decanted and n-heptane removed by distillation under a nitrogen purge. The stripped product was filtered through a Celite filtering media while hot.

Example 1 is illustrative of a control reaction without the addition of sulfur or a sulfurized compound. All of the examples set forth herein are performed at room temperature and a batch process is utilized; the components may be added in any order prior to the initial application of heat.

EXAMPLE 2

The procedure in Example 1 was followed with the following exceptions: 45 grams (0.75 moles) of ethylenediamine and 108 grams (0.75 moles) of molybdenum trioxide and 24 grams (0.75 moles) of elemental sulfur were used.

EXAMPLE 3

The procedure in Example 1 was followed with the following exceptions: 45 grams (0.75 moles) of ethylenediamine, 54 grams (0.375 moles) of molybdenum trioxide and 24 grams (0.75 moles) of elemental sulfur were used.

EXAMPLE 4

To a one liter, three-necked, round bottom flask was added 262 grams (1 mole) of dodecylphenol, 45 grams (0.75 moles) of ethylenediamine, 36 grams (0.25 moles) of molybdenum trioxide, 24 grams (0.75 moles) of elemental sulfur and 110 grams of SX-5. The reaction mixture was heated to 177°–182° C. and held at that temperature for four hours. At that time the mixture was allowed to cool to less than 66° C. and was diluted with about 450 ml of hexane. This mixture was allowed to settle overnight and the decanted solution was filtered and hexane removed by distillation under a nitrogen purge.

EXAMPLE 5

The procedure in Example 1 was followed with the following exceptions: 15 grams (0.25 moles) of ethylenediamine, 35 grams (0.25 moles) of molybdenum trioxide, 24 grams (0.75 moles) of elemental sulfur and no SX-5 were used.

EXAMPLE 6

The procedure in Example 1 was followed with the following exceptions: 15 grams (0.25 moles) of ethylenediamine, 18 grams (0.125 moles) of molybdenum trioxide and 24 grams (0.75 moles) of elemental sulfur were used.

EXAMPLE 7

The procedure in Example 1 was followed with the following exceptions: 15 grams (0.25 moles) of ethylenediamine, 12 grams (0.083 moles) of molybdenum trioxide and 24 grams (0.75 moles) of elemental sulfur were used.

EXAMPLE 8

To a one liter, three-necked, round bottom flask was added 524 grams (2 moles) of dodecylphenol, 17 grams (0.28 moles) of ethylenediamine, 31 grams (0.22 moles) of molybdenum trioxide and 48 grams (1.5 moles) elemental sulfur. The mixture was heated to 182° C. and held at that temperature for five hours. After cooling overnight, the mixture was heated to 93° C. and filtered through Celite filtering media.

EXAMPLE 9

The procedure in Example 1 was followed with the following exceptions: 8.4 grams (0.14 moles) of ethylenediamine, 10.1 grams (0.07 moles) of molybdenum trioxide and 24 grams (0.75 moles) of elemental sulfur were used.

EXAMPLE 10

The procedure in Example 1 was followed with the following exceptions: 8.4 grams (0.14 moles) of ethylenediamine, 6.7 grams (0.0465 moles) of molybdenum trioxide and 24 grams (0.75 moles) of sulfur were used.

TABLE I

| | REACTION PRODUCT OF EXAMPLE | | | | | | | | | | |
|---|---|---|---|---|---|---|---|---|---|---|---|
| | 1 | 2 | 3 | 4 | 5 | 6 | 7 | 8 | 9 | 10 | Base Blend w/o Additives |
| % Molybdenum | 2.8 | 4.3 | 5.7 | 5.3 | 4.0 | 1.4 | 1.1 | 0.4 | 1.3 | 0.15 | |
| (% Incorporated) | (49) | (32) | (75) | (100) | (55) | (35) | (58) | (10.5) | (81) | (13.6) | |
| % Sulfur | 0.03 | 2.1 | 3.7 | 4.1 | 4.8 | 3.1 | 2.6 | 4.1 | 2.7 | 3.1 | |
| (% Incorporated) | | (47) | (74) | (79) | (66) | (55) | (44) | (53) | (45) | (51) | |
| % Nitrogen | 0.3 | 1.9 | 2.2 | 2.8 | 0.15 | 0.9 | 0.4 | 0.4 | 0.2 | 0.8 | |
| (% Incorporated) | (21) | (48) | (50) | (62) | (7) | (52) | (25) | (27) | (17) | (86) | |
| Sulfur/Amine | 0 | 1 | 1 | 1 | 3 | 3 | 3 | 5.4 | 5.4 | 5.4 | |
| Amine/Molybdenum | 1 | 1 | 2 | 3 | 1 | 2 | 3 | 1 | 2 | 3 | |
| Nitrogen/Molybdenum | 0.7 | 3.0 | 2.6 | 3.6 | 0.3 | 4.4 | 2.5 | 6.9 | 1.1 | 3.0 | |
| % Activity | 38 | 60 | 52 | 47 | 65 | 46 | 26 | — | 19 | 31 | |
| Cu Strip Rating | 1A | 1B | 1B | 3B | 2C | 3B | 3B | — | 4A | — | |
| 4-Ball Test | .057 | .070 | .070 | .070 | .103 | .047 | .044 | — | .096 | — | .119 |
| Air Hot Tube Test | 2 | 2 | 2 | 2 | 3 | 1.5 | 3 | — | 7 | — | 2.8 |
| Amihot, ΔPb | −1.5 | −0.4 | −1.5 | −3.9 | −3.4 | −9.2 | −10.2 | — | −5.6 | — | 0, +0.4 |
| ΔCu | −40.3 | −14.4 | −30.3 | −30.9 | −11.1 | −22.2 | −29.4 | — | −11.8 | — | +0.2, −2.2 |
| Oil Thickening Test 24 hr | 100 | 100 | 100 | 93 | 100 | 92 | 100 | — | 100 | — | 100 |
| 40 hr | 94 | 95 | 95 | 93 | 100 | 92 | 78 | — | 85 | | 84 |

TABLE II

| | MOTORED ENGINE TEST (°F.) | | | | |
|---|---|---|---|---|---|
| | 200° | 220° | 240° | 260° | 280° |
| Baseline oil | 10.00 | 10.19 | 10.60 | 10.79 | 10.98 |
| Baseline oil + | 9.82 | 9.90 | 10.18 | 10.57 | 10.80 |

TABLE II-continued

| | MOTORED ENGINE TEST (°F.) | | | | |
|---|---|---|---|---|---|
| | 200° | 220° | 240° | 260° | 280° |
| Reaction Product of Example 5 | | | | | |

We claim:

1. An approved lubricating oil composition comprising a lubricating oil and a material consisting essentially of the reaction product of:

(a) a phenolic compound comprising an alkyl-substituted phenol with the alkyl side chain having at least nine carbon atoms;

(b) a molybdenum compound;

(c) an amine compound comprising a mono- or polyamine having at least one aliphatic hydrocarbon based radical or an aromatic or aliphatic-substituted aromatic radical; and (d) sulfur or a sulfur-yielding compound, said sulfur and said maine compound being present in amounts that will provide a sulfur/amine molar ratio that is within the range of 1:1 to 60:1, said reaction product being prepared by adding the reactants in any order at room temperature to form a reaction mixture, heating subsequently said mixture to an elevated temperature and holding said mixture at said elevated temperature for a period of time, said temperature and said time being sufficient to cause the formation of said reaction product.

2. The composition of claim 1 whereifn said molybdenum compound comprises molybdenum oxide or ammonium molybdate or the alkali metal salts thereof.

3. The composition of claim 1 wherein said phenolic compound is sulfurized by sulfur or a sulfur-yielding compound prior to addition as a reactant herein.

4. The composition of claim 1, wherein the alkyl side chain comprises a polymer of propene or butene, a homopolymer of propene or a polyethylene having from about 10 to about 20 carbon atoms.

5. The composition of claim 4 wherein said alkyl side chain comprises a trimer or tetramer of propene.

6. The composition of claim 1 wherein said sulfur or sulfur-yielding compound is present in excess quantities with a sulfur/amine ratio of 3 to 5, said elevated temperature is within the range of about 177° C. to about 182° C., and said period of time is within the range of about 4 to about 5 hours.

7. The composition of claim 1 wherein zinc dithophosphate is added to the lubricating oil.

* * * * *

UNITED STATES PATENT OFFICE

CERTIFICATE OF CORRECTION

Patent No. 4,466,901 Dated August 21, 1984

Inventor(s) Hunt, Mack W. - West, Charles T.

It is certified that error appears in the above-identified patent and that said Letters Patent are hereby corrected as shown below:

Column 1, line 34, "of" should be -- or --.

Column 1, line 48, "products" should be -- produces --.

Column 4, line 32, "dedecylphenol" should be -- dodecylphenol --.

Column 4, line 48, After "9" should be -- carbon --.

Column 9, line 9, "approved" should be -- improved --.

Column 9, line 21, "maine" should be -- amine --.

Column 10, line 5, "whereifn" should be -- wherein --.

Signed and Sealed this

*Fifth* Day of *March 1985*

[SEAL]

*Attest:*

DONALD J. QUIGG

*Attesting Officer* *Acting Commissioner of Patents and Trademarks*